US007601952B2

(12) United States Patent
Hager et al.

(10) Patent No.: US 7,601,952 B2
(45) Date of Patent: Oct. 13, 2009

(54) METHOD OF OPERATING A MASS SPECTROMETER TO PROVIDE RESONANT EXCITATION ION TRANSFER

(75) Inventors: Jim Hager, Mississauga (CA); Bruce Thomson, Toronto (CA)

(73) Assignees: MDS Analytical Technologies, a business unit of MDS Inc., Concord, Ontario; Applied Biosystems, Inc., Framingham, MA (US)

( * ) Notice: Subject to any disclaimer, the term of this patent is extended or adjusted under 35 U.S.C. 154(b) by 267 days.

(21) Appl. No.: 11/778,954

(22) Filed: Jul. 17, 2007

(65) Prior Publication Data

US 2008/0017789 A1 Jan. 24, 2008

Related U.S. Application Data

(60) Provisional application No. 60/807,779, filed on Jul. 19, 2006.

(51) Int. Cl.
*H01J 49/00* (2006.01)

(52) U.S. Cl. ..... 250/292; 250/290; 250/288; 250/282; 250/281

(58) Field of Classification Search ..... 250/281, 250/282, 283, 288, 290, 292
See application file for complete search history.

(56) References Cited

U.S. PATENT DOCUMENTS 6,744,043 B2 6/2004 Loboda
6,838,662 B2 1/2005 Bateman et al.
7,045,797 B2 * 5/2006 Sudakov et al. ..... 250/292
7,495,213 B2 * 2/2009 Loboda ..... 250/292
2004/0108456 A1 * 6/2004 Sudakov et al. ..... 250/288
2004/0245455 A1 * 12/2004 Reinhold ..... 250/288
2005/0253064 A1 * 11/2005 Loboda et al. ..... 250/292
2005/0263695 A1 * 12/2005 Syka ..... 250/291
2005/0263697 A1 12/2005 Hager et al.
2006/0118716 A1 * 6/2006 Michaud et al. ..... 250/292

OTHER PUBLICATIONS

International Search Report, PCT/CA2007/001256.

* cited by examiner

*Primary Examiner*—David A Vanore
*Assistant Examiner*—Michael J Logie
(74) *Attorney, Agent, or Firm*—Bereskin & Parr LLP/S.E.N.C.R.L., s.r.l.

(57) ABSTRACT

A method of operating a mass spectrometer having a rod set is provided. The rod set has a first end, a second end opposite to the first end, and a longitudinal axis extending between the first end and the second end. The method comprises a) admitting ions into the rod set; b) trapping at least some of the ions in the rod set by i) producing a first barrier field at a first end member adjacent to the first end of the rod set, ii) producing a second barrier field at a second end member adjacent to the second end of the rod set, and iii) providing an aggregate field comprising an RF field between the rods of the rod set; c) selecting a first selected mass to charge ratio of a first group of ions in the ions; d) determining a first excitement level of a selected characteristic of the aggregate field for the first group of ions; e) adjusting the selected characteristic of the aggregate field to the first excitement level to resonantly excite the first group of ions to mass selectively eject the first group of ions from the rod set past the barrier field; and, f) maintaining the selected characteristic of the aggregate field at the first excitement level during an excitement time interval wherein the excitation time interval is at least 1 millisecond.

31 Claims, 16 Drawing Sheets

METHOD OF OPERATING A MASS SPECTROMETER TO PROVIDE RESONANT EXCITATION ION TRANSFER

RELATED APPLICATION

This application claims the benefit of U.S. Provisional Patent Application Ser. No. 60/807,779, filed Jul. 19, 2006, the entire content of which is hereby incorporated by reference.

FIELD OF THE INVENTION

The present invention relates generally to mass spectrometry, and more particularly relates to a method of operating a mass spectrometer to provide resonant excitation ion transfer.

INTRODUCTION

Typically, linear ion traps store ions using a combination of a radial RF field applied to the rods of an elongated rod set, and axial direct current (DC) fields applied to the entrance end and the exit end of the rod set. As described in U.S. Pat. No. 6,177,668, ions trapped within the linear ion trap can be scanned mass dependently axially out of the rod set and past the DC field applied to the exit lens.

SUMMARY OF THE INVENTION

In accordance with an aspect of an embodiment of the invention, there is provided a method of operating a mass spectrometer having a rod set, the rod set having a first end, a second end opposite to the first end, and a longitudinal axis extending between the first end and the second end. The method comprises a) admitting ions into the rod set; b) trapping at least some of the ions in the rod set by i) producing a first barrier field at a first end member adjacent to the first end of the rod set, ii) producing a second barrier field at a second end member adjacent to the second end of the rod set, and iii) providing an aggregate field comprising an RF field between the rods of the rod set; c) selecting a first selected mass to charge ratio of a first group of ions in the ions; d) determining a first excitement level of a selected characteristic of the aggregate field for the first group of ions; e) adjusting the selected characteristic of the aggregate field to the first excitement level to resonantly excite the first group of ions to mass selectively eject the first group of ions axially from the rod set past the barrier field; and, f) maintaining the selected characteristic of the aggregate field at the first excitement level during an excitement time interval wherein the excitation time interval is at least 1 millisecond.

In accordance with yet another aspect of an embodiment of the invention, the above-described method is modified in that in (e) the selected characteristic of the aggregate field is adjusted to the first excitement level to resonantly excite the first group of ions to mass selectively eject the first group of ions radially from the rods that pass the barrier field. In other words, the ions may optionally be ejected radially instead of axially.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION OF EMBODIMENTS OF THE INVENTION

Figure 1A:
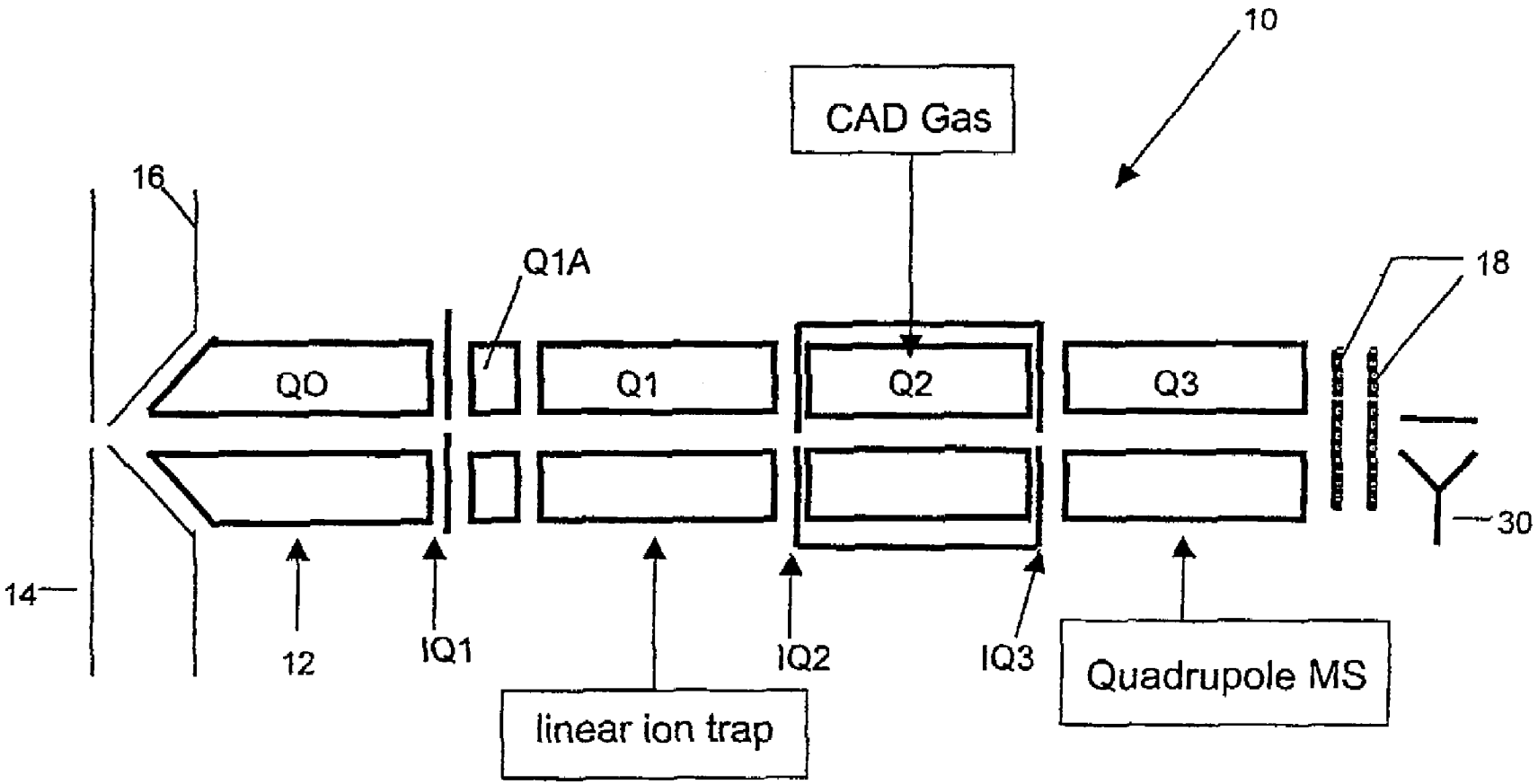
FIG. 1*a*, in a schematic diagram, illustrates a Q-trap Q-q-Q linear ion trap mass spectrometer.
Figure 1B:
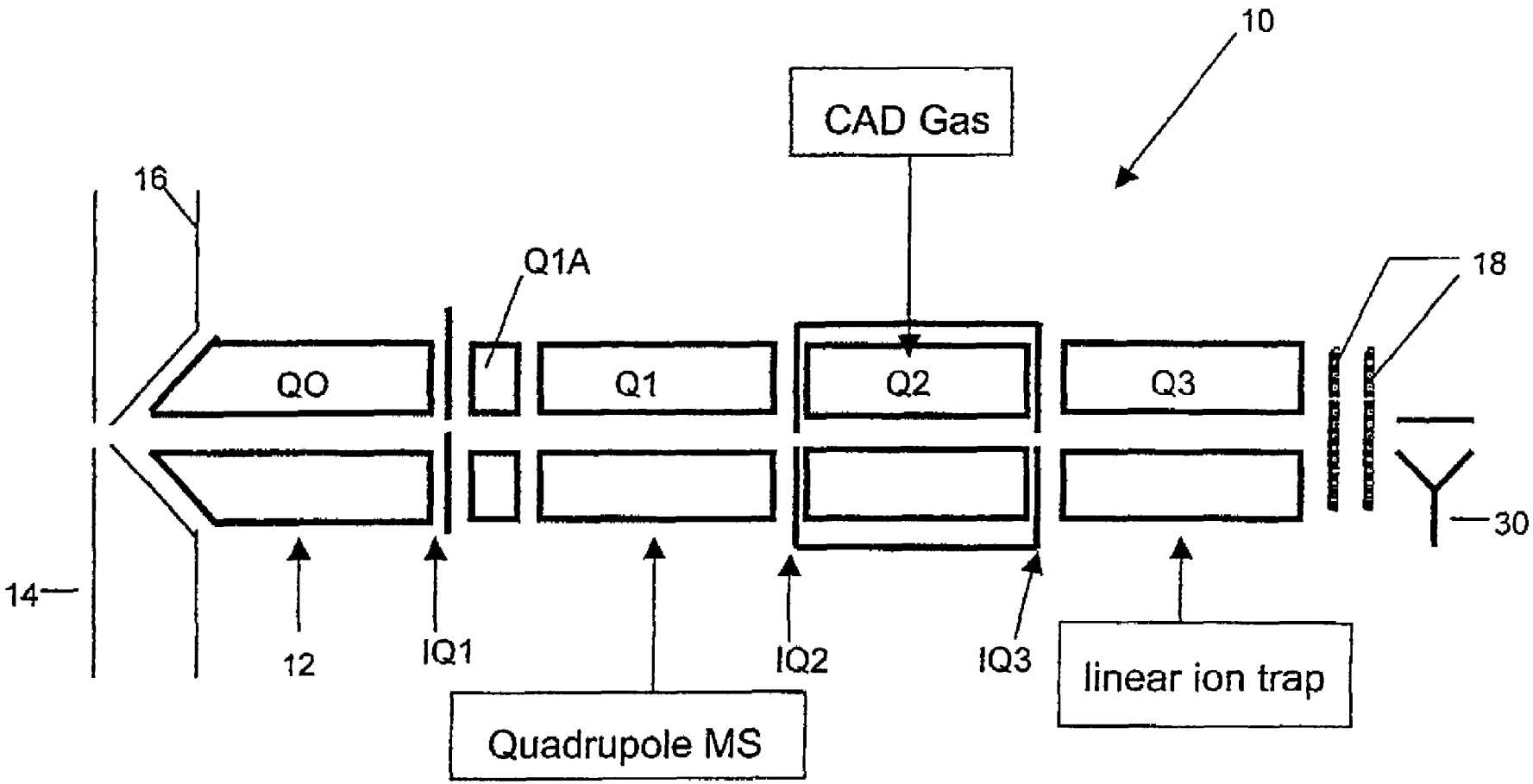
FIG. 1*b*, in a schematic diagram, illustrates an alternative variant of a Q-trap Q-q-Q linear ion trap mass spectrometer.
Figure 1C:
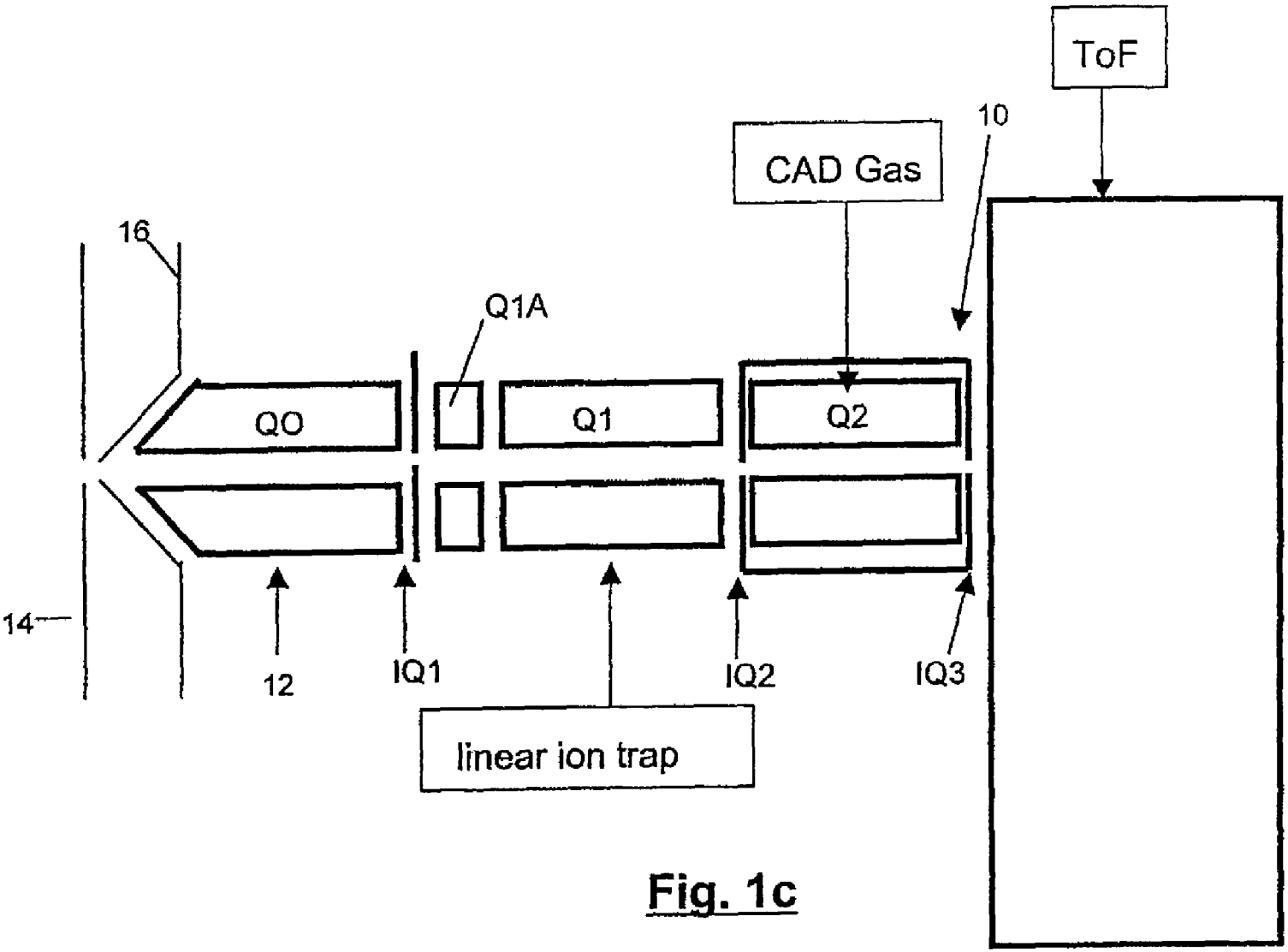
FIG. 1*c*, in a schematic diagram, illustrates a linear ion trap mass spectrometer comprising a Time of Flight (ToF) mass spectrometer.
Figure 1D:
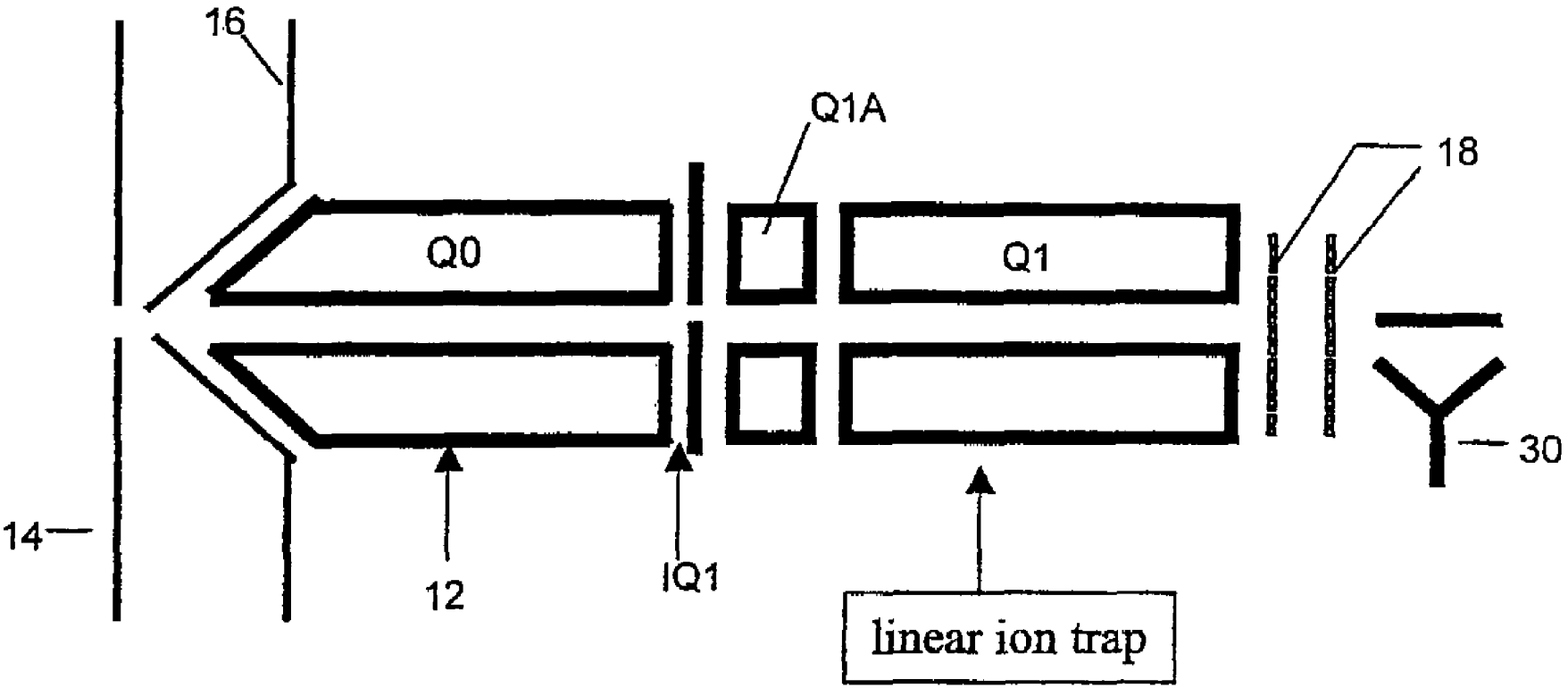
FIG. 1*d*, in a schematic diagram, illustrates a further variant of a linear ion trap mass spectrometer system.
Figure 1E:
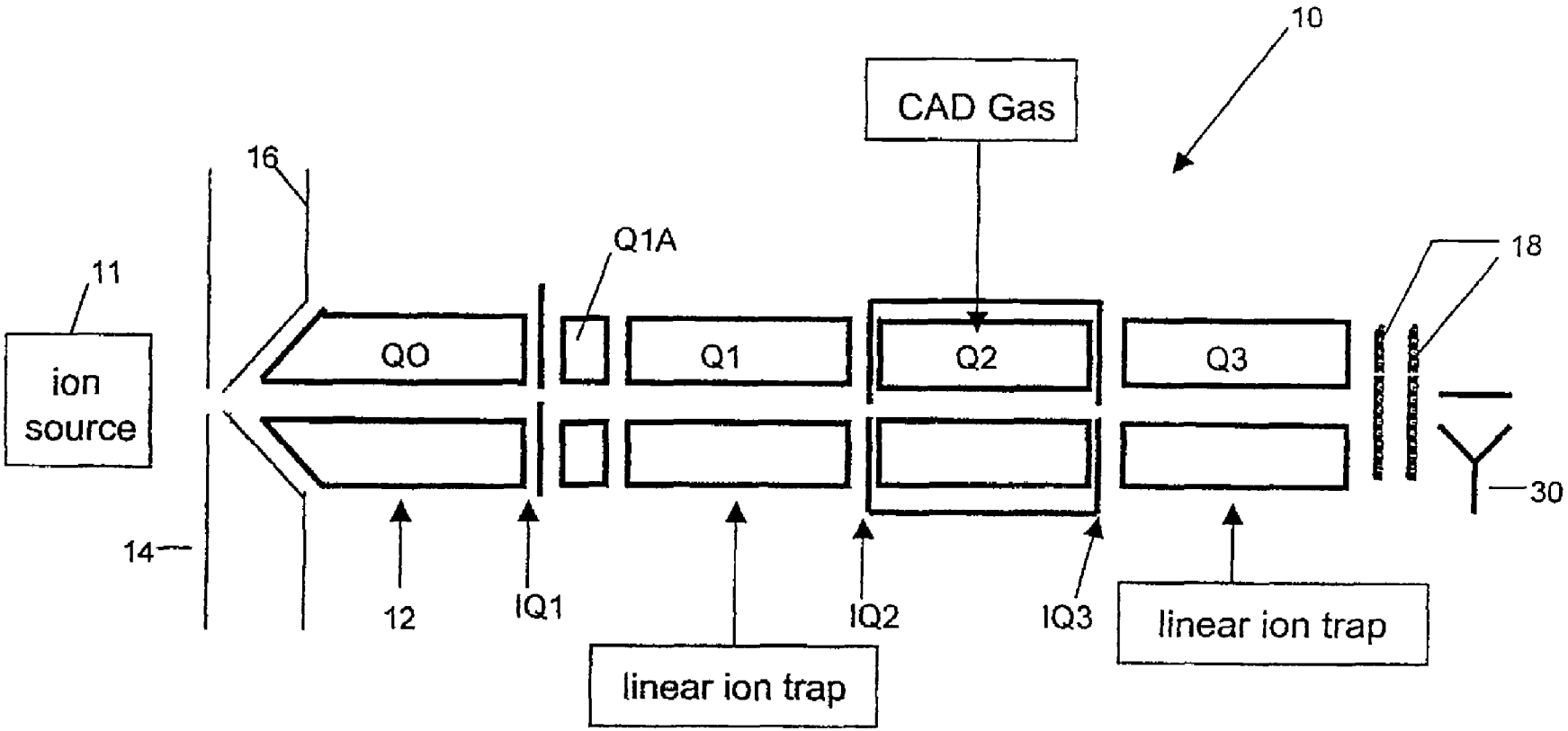
FIG. 1*e*, in a schematic diagram, illustrates a yet further alternative variant of a Q-trap Q-q-Q linear ion trap mass spectrometer.

Referring to FIGS. 1*a*, 1*b*, and 1*e* there are illustrated in schematic diagrams different variants of Q-trap Q-q-Q linear ion trap mass spectrometers, as described U.S. Pat. No. 6,504,148 and by Hager and LeBlanc in Rapid Communications of Mass Spectrometry, 2003, 17, 1056-1064, respectively. During operation of the mass spectrometer, ions are admitted into a vacuum chamber 12 through an orifice plate 14 and skimmer 16. Any ion source 11, such as, for example, MALDI, nanospray or ESI, can be used. The linear ion trap 10 comprises four elongated sets of rods Q0, Q1, Q2 and Q3, with orifice plates IQ1 after rod set Q0, IQ2 between Q1 and Q2, and IQ3 between Q2 and Q3. An additional set of stubby rods Q1*a* is provided between orifice plate IQ1 and elongated rod set Q1.

In some cases, fringing fields between neighboring pairs of rod sets may distort the flow of ions. Stubby rods Q1*a* are provided between orifice plate IQ1 and elongated rod set Q1 to focus the flow of ions into the elongated rod set Q1.

Ions are collisionally cooled in Q0, which may be maintained at a pressure of approximately $8\times10^{-3}$ torr. In FIG. 1*a*, Q1 operates as a linear ion trap, while Q3 operates as a conventional transmission RF/DC quadrupole mass spectrometer. In FIG. 1*b*, the configuration of Q1 and Q3 is reversed, such that Q1 operates as the conventional transmission RF/DC quadrupole mass spectrometer and Q3 operates as a linear ion trap. In FIG. 1*e*, both Q1 and Q3 operate as linear ion traps. In the variants of FIGS. 1*a*, 1*b*, and 1*e*. Q2 is a collision cell in which ions collide with a collision gas to be fragmented into products of lesser mass. In some cases Q2 can be used as a reaction cell in which ion-neutral or ion-ion reactions occur to generate other types of fragments or adducts. In addition to being operable to trap a wide mass range of ions, Q1 in the variant of FIG. 1*a* and Q3 in the variant of FIG. 1*b* can be operated as linear ion traps with mass selective axial ejection, as described by Londry and Hager in the Journal of the American Association of Mass Spectrometry, 2003, 14, 1130-1147, and in U.S. Pat. No. 6,177,688, the contents of which are hereby incorporated by reference.

Typically, ions can be trapped in the linear ion traps Q1 and Q3 of FIGS. 1*a* and 1*b*, respectively, (or either Q1 or Q3 in the case of FIG. 1*e*) using radial RF voltages applied to the quadrupole rods, and DC voltages applied to the end aperture lenses. The space charge in Q1 may be controlled by, for example, controlling the number of MALDI laser pulses, or by throttling an ion beam in an ESI source by pulsing a lens element upstream (such as the skimmer 16 in FIG. 1). DC voltage differences between the end aperture lenses and the rod set can be used to provide the barrier fields. Of course, no actual voltage need be provided to the end lenses themselves, provided an offset voltage is applied to Q1 or Q3 to provide the DC voltage difference. Alternatively, a time-varying barrier, such as an AC or RF field, may be provided at the end aperture lenses. In cases where DC voltages are used at each end of linear ion trap Q1 or Q3 of FIGS. 1*a* and 1*b* respectively to trap the ions, the voltage differences provided at each end may be the same, or may be different. In many embodiments, the different linear ion traps can operate in a pressure range of $1\times10^{-5}$ torr to $5\times10^{-5}$ torr, although the pressure can, in other embodiments, be as high as $1\times10^{-3}$ torr. The high pressure mass spectrometer will operate at a pressure that is at least twice the operating pressure of the linear ion trap. In many embodiments, the high pressure mass spectrometer can operate at a pressure that more than ten times the operating pressure of the linear ion trap.

Referring to FIG. 1*c*, a further variant of a linear ion trap mass spectrometer system is illustrated. The linear ion trap mass spectrometer system of FIG. 1*c* is the same as that of FIG. 1*a*, except that in FIG. 1*c*, the quadrupole mass spectrometer Q3 is replaced with a Time of Flight (ToF) mass spectrometer. For brevity, the description of FIG. 1*a* is not repeated with respect to 1*c*. For clarity, analogous elements between the linear ion trap mass spectrometer system of FIG. 1*a* and the linear ion trap mass spectrometer system of FIG. 1*c* are designated by the same reference numerals.

Different aspects of embodiments of the present invention can be implemented using any of the linear ion trap mass spectrometer systems of FIGS. 1*a*, 1*b* and 1*c* as described below. For example, in the linear ion trap mass spectrometer systems of FIGS. 1*a* and 1*c*, the operating conditions of linear ion trap Q1 can be rapidly changed or jumped to excite ions of a specific mass-to-charge (m/z). Similarly, the operating conditions of Q3 in the linear ion trap mass spectrometer system of FIG. 1*b* can be rapidly changed or jumped to improve mass selective axial ejection efficiencies.

As described above, ions are admitted into Q1 via Q0 and stubby rods Q1*a*. In the linear ion trap mass spectrometer systems of FIGS. 1*a* and 1*c*, and 1*e* rod set Q1 is a linear ion trap that can be used to trap the ions received via Q0. As described above, these ions can be trapped by producing barrier fields at each end of the rods set Q1 and also by providing an RF field between the rods of Q1. Then, a first group of ions, having a selected mass to charge ratio, can be selected for axial ejection. Next, a rapid shift or jump in the operating conditions of Q1 required to resonantly excite this first group of ions is determined. This rapid shift or jump can be made to (i) an amplitude of the RF field; and/or, (ii) a frequency of the RF field. Alternatively, an aggregate field including not only the RF field applied between the rods of Q1, but also an excitation AC field can be applied, in which case the frequency of the excitation AC field may be rapidly shifted or jumped to bring the first selected group of ions into resonance. This excitation AC field may be either a dipolar excitation field or a quadrupole excitation field, provided directly to the Q1 rods or via a set of auxiliary electrodes included in Q1. Alternatively, AC voltage may be applied to the lens to provide an excitation field.

In some aspects of an embodiment of the invention, the amplitude of the RF field is jumped to the excitement level. At that point, after the magnitude of the RF voltage is at the first excitement level, the auxiliary excitation AC field is initiated to resonantly excite the selected ions. In other aspects of this embodiment of the invention, the AC excitation field is left on during the rapid shift or jump in the amplitude of the RF field.

Once a selected characteristic of the aggregate field (which may, as described above, be an amplitude of the RF field, a frequency of the RF field, or a frequency of the excitation AC field) is jumped or rapidly shifted to a first excitement level for resonantly exciting the first group of ions, this selected characteristic of the aggregate field is maintained at this excitement level for an excitement time interval, which can be at least 1 millisecond. During this excitement time interval the selected characteristic can be kept substantially constant. Alternatively, even if the different characteristics of the aggregate field are adjusted during this excitation time interval, they can be adjusted to maintain overall field characteristics that resonantly excite the first group of ions to mass selectively eject the first group of ions axially from the rod set past the barrier field. For example, say that the frequency of the RF field is varied during the excitement time interval. Then the first group of ions can still be continuously resonantly excited during this excitement interval if the amplitude of the RF field is simultaneously varied to compensate for the variation in the frequency of the RF field.

In the manner described above, different groups of ions of different selected mass to charge ratios can be sequentially resonantly excited, and axially ejected, from Q1 (or in the case of FIG. 1*b*, Q3). For example, after the first group of ions are resonantly excited and axially ejected during the first excitement time interval described above, the selected characteristic of the aggregate field can be adjusted to a second excitement level to resonantly excite a second group ions to mass selectively eject the second group of ions axially from Q1, in FIGS. 1*a*, 1*c*, and 1*e* and Q3, in FIG. 1*b*, past the barrier field. This second group of ions of a second selected mass to charge ratio may have been previously selected, and the second excitement level of the selected characteristics of the aggregate field for the second group of ions previously determined. The selected characteristic of the aggregate field is then maintained at the second excitement level during a second excitement time interval. The second excitement time interval can be at least 1 millisecond. As described above, the selected characteristic of the aggregate field may be an amplitude of the RF field, a frequency of the RF field or a frequency of the excitation AC field.

According to some aspects of the invention, the step of adjusting the selected characteristic of the aggregate field to the second excitement level from the first excitement level is executed very quickly, such that the adjustment time interval between the first excitement time interval in which the first group of ions are resonantly excited, and the second excitement time interval during which the second group of ions are resonantly excited, can be less than 1 millisecond. Further, unlike the situation that typically prevails when field characteristics are scanned to sequentially bring ions of different m/z into resonant excitation, when these field conditions are abruptly shifted, and then held constant for longer periods of time, non-contiguous mass values can be ejected by jumping or stepping from one specified mass value to another that is more than 1 amu different. Typically, this is not done in scanning mode. In a scanning mode, all ions within a defined mass range are sequentially ejected in order of m/z. According to aspects of this invention, ions with m/z values between the two selected groups of ions can be retained in the trap if they are stable in the RF field.

Referring back to FIG. 1*b*, the first group of ions and second group of ions can be axially ejected past an exit lens 18 to an ion detector 30 for detection. Alternatively, using the linear mass spectrometer systems of FIG. 1*a* or 1*c*, the first group of ions can be axially ejected from Q1 into Q2, where this first group of ions is fragmented. Then, in the linear ion trap mass spectrometer system 10 of FIG. 1*a*, the first group of ions can be ejected to transmission quadrupole mass spectrometer Q3, where particular fragment ions of interest are selected and transmitted past exit lens 18 to detector 30 for detection. Alternatively, using the linear ion trap mass spectrometer system of FIG. 1*c*, the fragments from Q2 can be transmitted to a Time of Flight mass spectrometer, which uses drift times to measure the m/z of particular fragments of interest. Alternatively, fragments of the first group of ions could be axially ejected to a second linear ion trap, as shown in FIG. 1*e*, and a selected characteristic of an aggregate field provided to that second linear ion trap could be rapidly shifted or jumped to resonantly excite a group of fragment ions of interest to mass selectively eject this group of fragment ions axially from the rod set past the barrier field, in a manner analogous to that described above.

In order to conserve sample and use ions more efficiently, ions can be stored in Q0 while the ions in the LIT (whether Q1 or Q3) are processed and ejected. This can be accomplished by setting a lens between Q0 and Q1, or IQ1 to be repulsive. Alternately, in order to conserve sample material, the ion source can be turned on to fill the LIT, and then turned off while the ions are processed and transferred from the LIT. A MALDI source can be pulsed one or more time to fill the trap, and then turned of. A nanospray source can be turned on to fill the trap with sufficient ions, and then turned off. The fill time can be chosen to select an optimum number of ions to minimize space charge effects.

For example, in the case where the sample ions are stored in a high pressure mass spectrometer, which, in one embodiment is operating at a high pressure range of $2\times10^{-3}$ torr to $10^{-2}$ torr, a first batch of ions could be transmitted from Q0 to Q1. While this first batch of ions is being transmitted from Q0 to Q1, a barrier-generating member such as IQ1, or alternatively a lens (not shown) between Q0 and Q1, can be in an attractive mode to facilitate the transfer of this first batch of ions. Then, once the first batch of ions is within Q1, the barrier-generating member between Q0 and Q1, whether IQ1 or the lens mentioned above or some other suitable member, can be switched to a repulsive mode to facilitate retention of the remaining sample ions in Q0 and separation of these ions from the ions in Q1. After this first batch of ions has been processed through the linear ion trap mass spectrometer system 10 of any of FIGS. 1*a* to 1*e*, the barrier-generating member between Q0 and Q1 can be switched again to attractive mode to facilitate the transfer of a second batch of ions from Q0 to Q1. In this manner, second and subsequent batches of ions can be separately processed, enabling ion samples to be used more efficiently.

Optionally, aspects of the present invention can be applied using a simpler linear ion trap system as shown in FIG. 1*d*. For clarity, analogous elements of the linear ion trap mass spectrometer system of FIG. 1*a* and the linear ion trap mass spectrometer system of FIG. 1*d* are designated by the same reference numerals. For brevity, the description of FIGS. 1*a* and 1*b* is not repeated with respect to FIG. 1*d*. When implemented on the linear ion trap system of FIG. 1*d*, the first group of ions can be resonantly excited and axially ejected from Q1 past exit lens 18 to detector 30 for detection.

Experimental Results

Experimental measurements have been conducted on three different platforms, all of which are available from MDS Sciex, 71 Four Valley Drive, Concord, Ontario, Canada, L4K 2V8: QTRAP, 4000QTRAP and QSTAR XL. For the QTRAP instrument, both the Q1 and Q3 linear ion traps were configured with dipolar resonance excitation. For the 4000QTRAP instrument Q3 was configured with dipolar excitation. The QSTAR XL Q1 linear ion trap allowed resonant excitation in a quadrupole fashion.

Transfer from Q3 Linear Ion Trap

Figure 2:
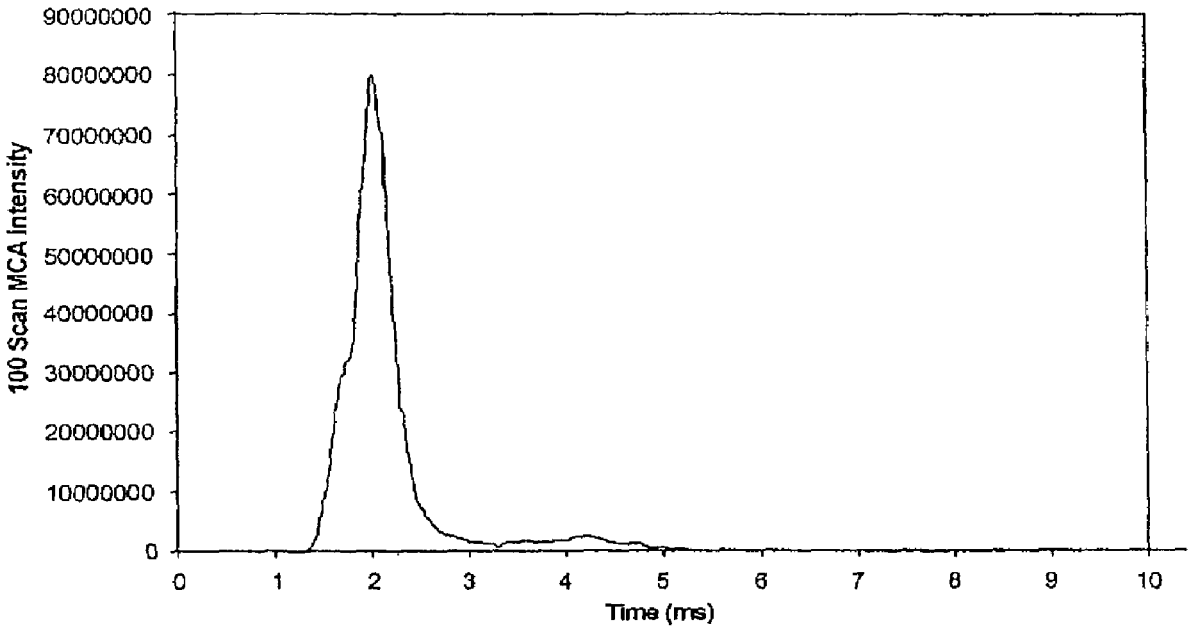
FIG. 2, in a graph, illustrates resonance excitation ion transfer from a Q3 linear ion trap of a 4000QTRAP in accordance with an aspect of an embodiment of an invention.

Resonance excitation ion transfer from a Q3 linear ion trap of a 4000QTRAP in accordance with an aspect of an embodiment of an invention is shown in FIG. 2. The Q3 linear ion trap had previously been filled with only the primary isotope of the Agilent $922^+$ ion. The temporal profile of the $922^+$ ejection in this case is about 400 usec.

Figure 3:
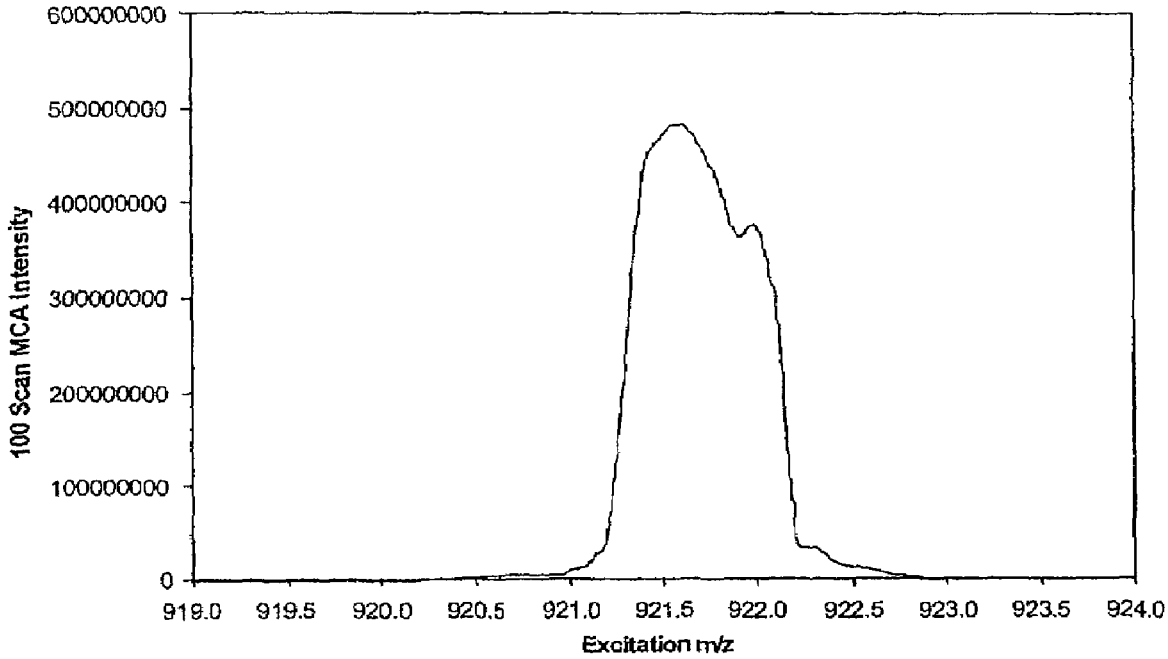
FIG. 3, in a graph, illustrates the associated "resolution" of the resonance excitation transfer process of FIG. 2.

The associated selectivity of the resonance excitation transfer process of FIG. 2 is shown in FIG. 3, which maps the ejected ion signal against excitation m/z. The apparent mass resolution in FIG. 3 is approximately 0.8 amu. Mass resolution is also a function of excitation amplitude. Increasing auxiliary voltage amplitude results in poorer resolution.

Figure 6A:
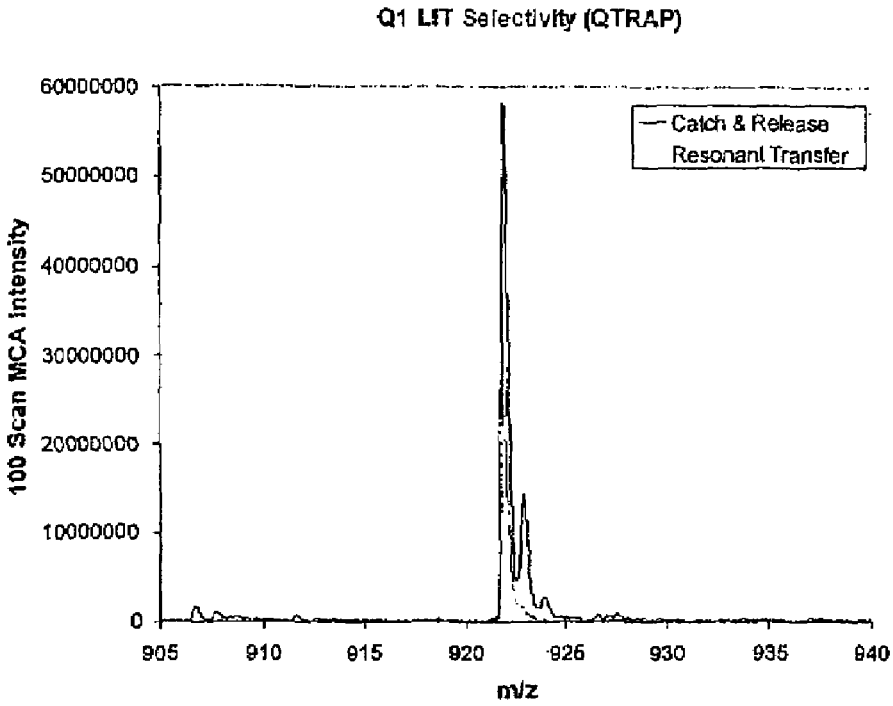
FIGS. 6*a* and 6*b*, in graphs with different scales on the Y axis, illustrate examples of the mass selected capabilities of a Q1 linear ion trap of a QTRAP with resonant excitation ion transfer.

The mass selective transfer efficiency obtained by jumping the field characteristics to the m/z of the analyte ion under conditions of resonance excitation can compare favourably with the traditional method of scanning the RF voltage. That is, for example, scanning at 1000 amu/sec can yield an extraction efficiency of approximately 18%, while resonance excitation can result in an ejection efficiency of approximately 38%, as shown in FIG. 6*a*.

Transfer from Q1 Linear Ion Trap

Figure 4:
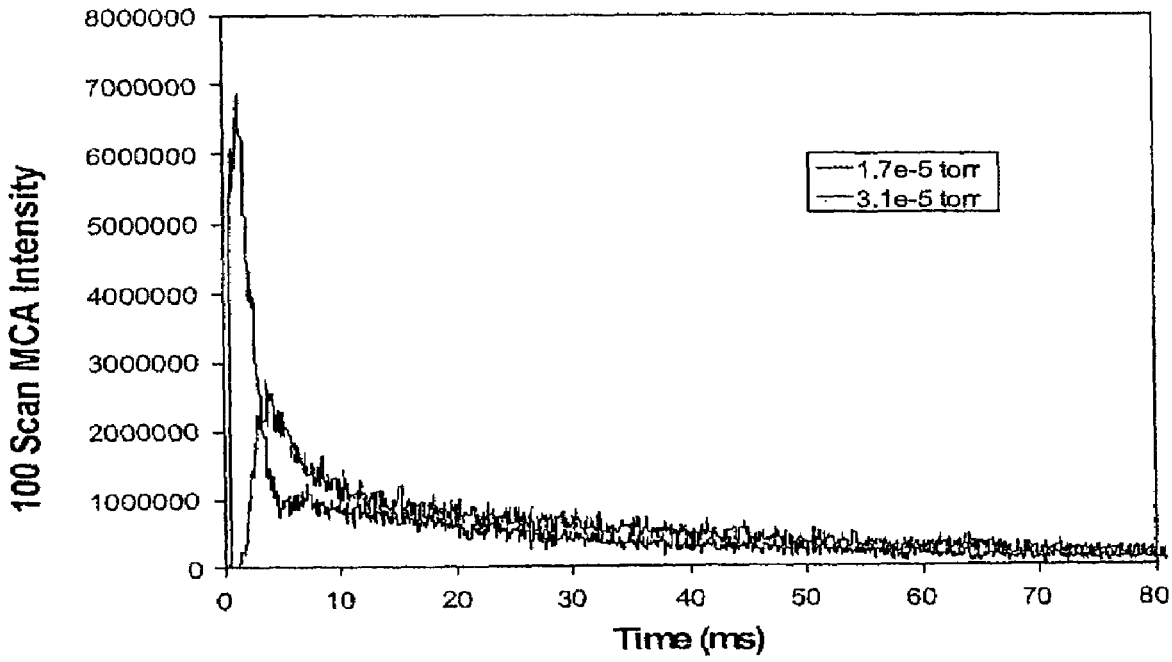
FIGS. 4 and 5, in graphs, illustrate ion resonance transfer from a Q1 linear ion trap of QTRAP and QSTAR instruments respectively, in which a pressurized collision cell is used.
Figure 5:
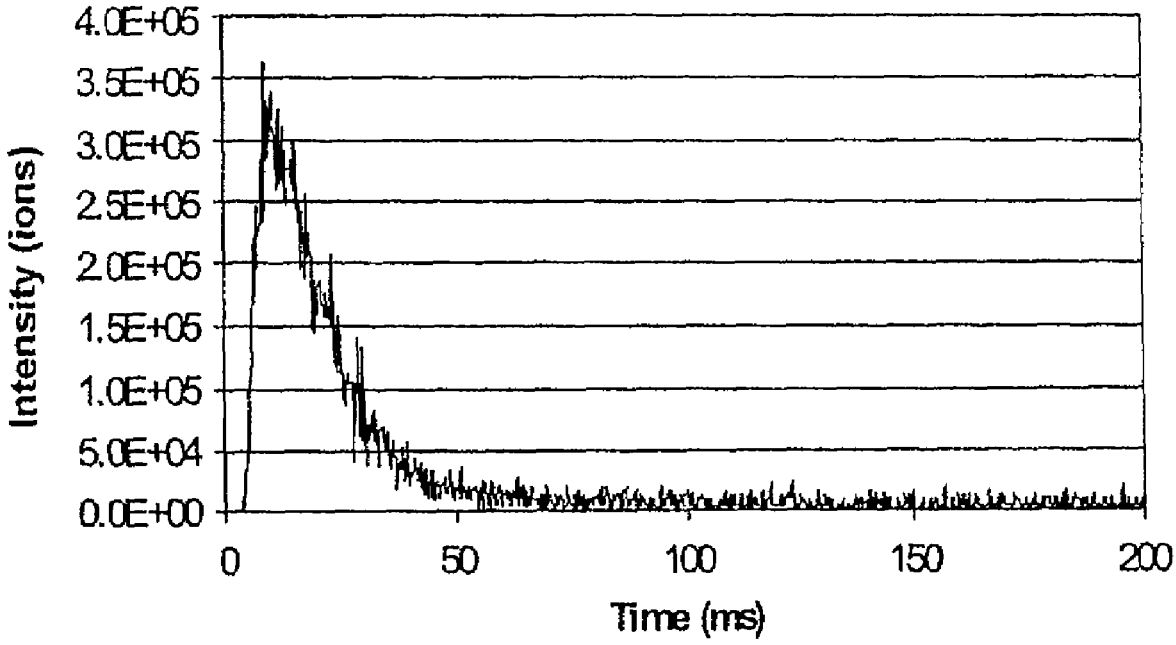

Experiments were also conducted on both the QTRAP and QSTAR instruments to test resonance transfer from a Q1 linear ion trap. In both cases, ions from the source were trapped in a Q1 linear ion trap, cooled, then ejected and transferred through a pressurized collision cell and mass analyzed further downstream. The presence of the pressurized collision cell broadens the temporal profile on both instruments as shown in FIGS. 4 and 5. Increasing the CAD gas pressure in Q2 leads to a further broadening of the temporal profile. Note that the QTRAP instrument can be configured with a tilted rod LINAC (U.S. Pat. No. 6,111,250) with a relatively small imposed axial field in Q2.

Additional measurements were made on QSTAR XL configured with a LINAC that uses auxiliary electrodes in the collision cell to generate a stronger axial field. The resulting temporal profile is shown in FIG. 5.

Figure 6B:
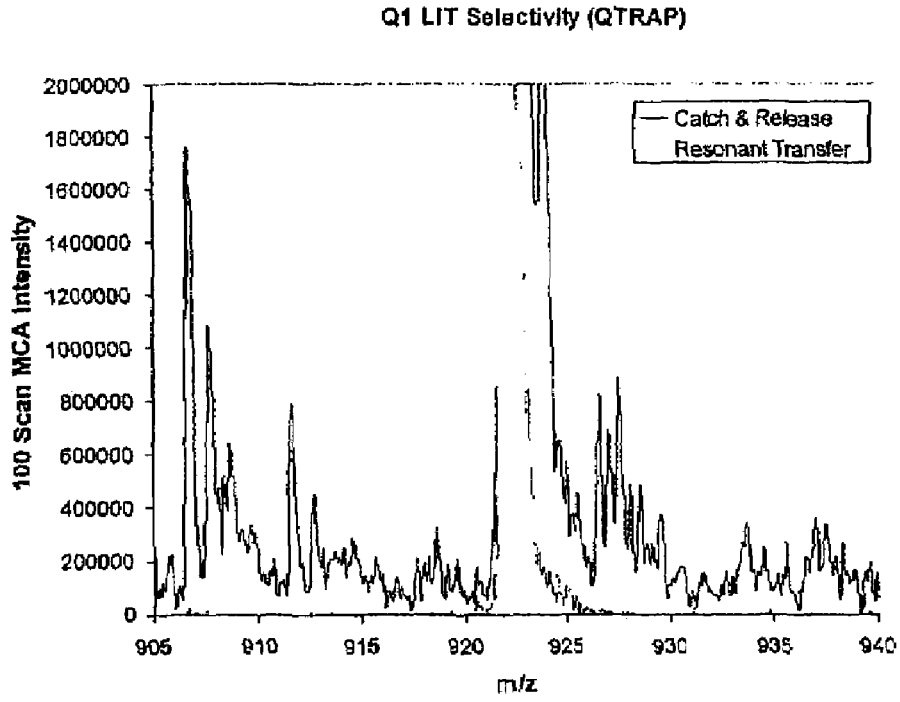

Referring to FIGS. 6*a* and 6*b*, examples of the mass selective capabilities of a Q1 linear ion trap of a QTRAP with resonant excitation ion transfer are shown. FIGS. 6*a* and 6*b* plot the same data, but at different scales along the Y axis. FIGS. 6*a* and 6*b* shows the mass selectivity of the resonance excitation ion transfer process from a Q1 linear ion trap of a QTRAP instrument can be approximately "unit".

By operating the linear ion trap in the manner described above, relatively high efficiencies and narrow temporal characteristics can be achieved, thereby improving instrument sensitivities. The narrower temporal characteristics may also imply an enhanced ability to eject ions of disparate mass to charge ratios in shorter periods of time than achievable using typical scanning. This, in turn, may provide an improved capability of removing selected ions for further ion processing, on demand, for very high duty cycles. This may be very useful in facilitating multiplexing operation in which a linear ion trap is filled once, and then selected ions are sequentially ejected on demand for further processing. Such multiplexing could provide more efficient use of a limited ion signal, and therefore better signal-to-noise, relative to existing methods that may allow for only one precursor ion at a time to be processed, with the other precursors being wasted during this processing time.

Figures 10A, 10B, 10C:
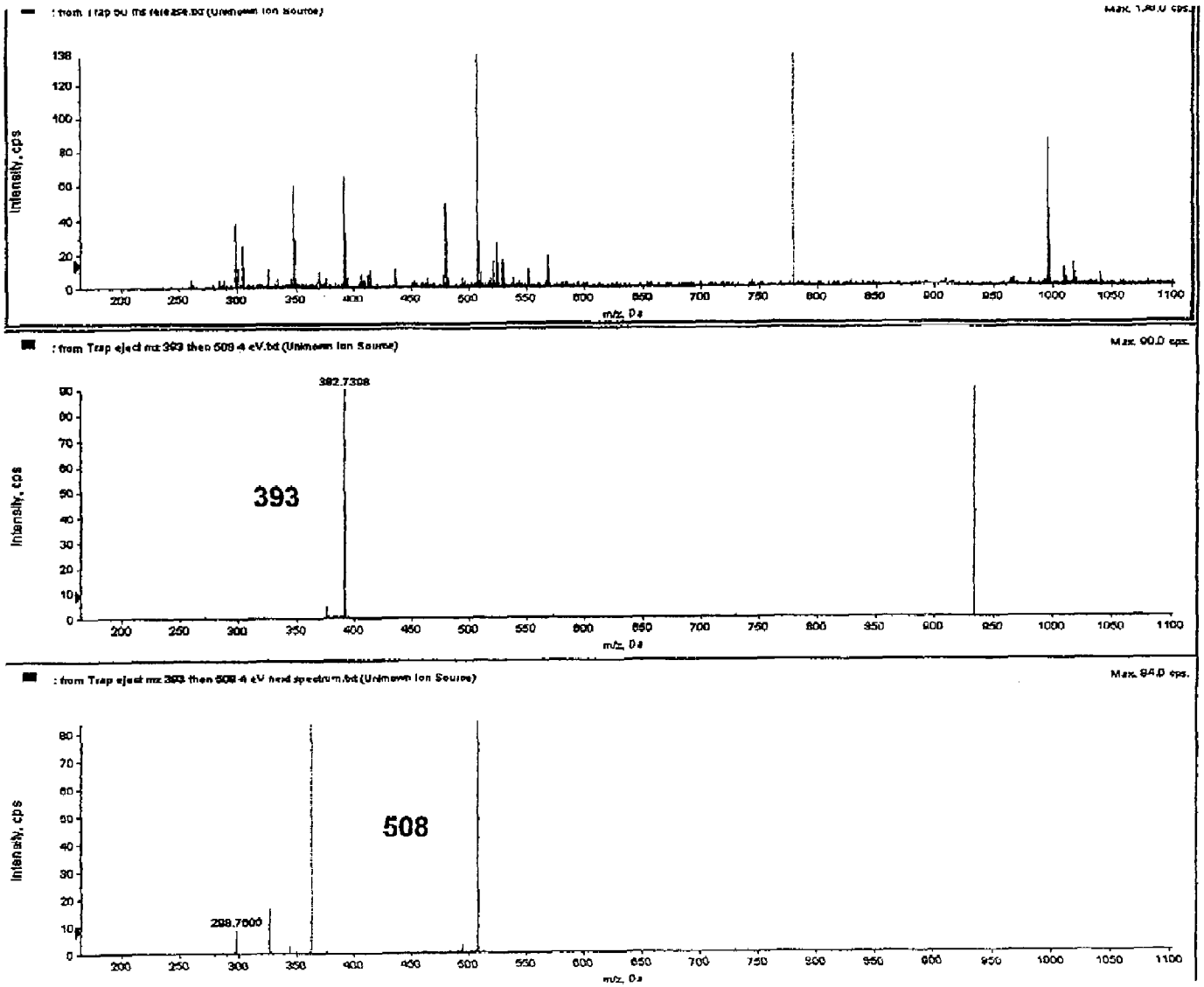
FIG. 10*a* illustrates an initial phase of a method in accordance with an aspect of the invention in which ions of m/z 393 and 508 are trapped in Q1 of a QSTAR.
FIG. 10*b* shows a mass spectrum during a subsequent phase of the method of FIG. 10*a* in which the ions of m/z 393 are brought into resonance and ejected to Q2.
FIG. 10*c* shows a mass spectra of a step within the method of FIG. 10*a* after the step of FIG. 10*b*, in which the ions of m/z 508 are brought into resonance and ejected to Q2.

For example, ions from an electrospray source were trapped in Q1 of a QSTAR for a period of for a period of 30 ms. Then ions of mass 393 were ejected through Q2 and then to the time of flight mass analyzer. While this ejection step was occurring, all other ions greater in mass than about m/z 305 remain in the Q1 trap. After about 50 ms of resonantly exciting m/z 393, the RF voltage on Q1 could be stepped to a new value to cause m/z 508 to come into resonance and be ejected to Q2. Thus, by filling Q1 with ions from the source, then stepping from one RF voltage to another without refilling, ions of two different m/z can be ejected from Q1 sequentially. FIG. 10 shows the spectra resulting from this experiment. In FIG. 10*a*, the spectrum of all ions from the source is displayed, showing the presence of many precursor ions of different m/z. FIG. 10*b* shows the TOF spectrum that results from just ejecting m/z 393 from the QTRAP through Q2 and into the TOF. FIG. 10*c* shows the result of then ejecting just m/z 508 into the TOF. In both cases, only the ion of interest is observed in the TOF spectrum. In this experiment, the collision energy was maintained at a low value so that the precursor ions were not fragmented in Q2, in order to demonstrate the principle. By increasing the collision energy, the MSMS spectra of each of the two ions could be recorded, and different collision energies could be selected for each precursor ion in order to optimize the degree of fragmentation. This process can be extended to record spectra from several different precursor ions. After each cycle, the QTRAP can be refilled with ions from the source.

Examples of Jumps in the RF and Auxiliary Voltages

Figure 7:
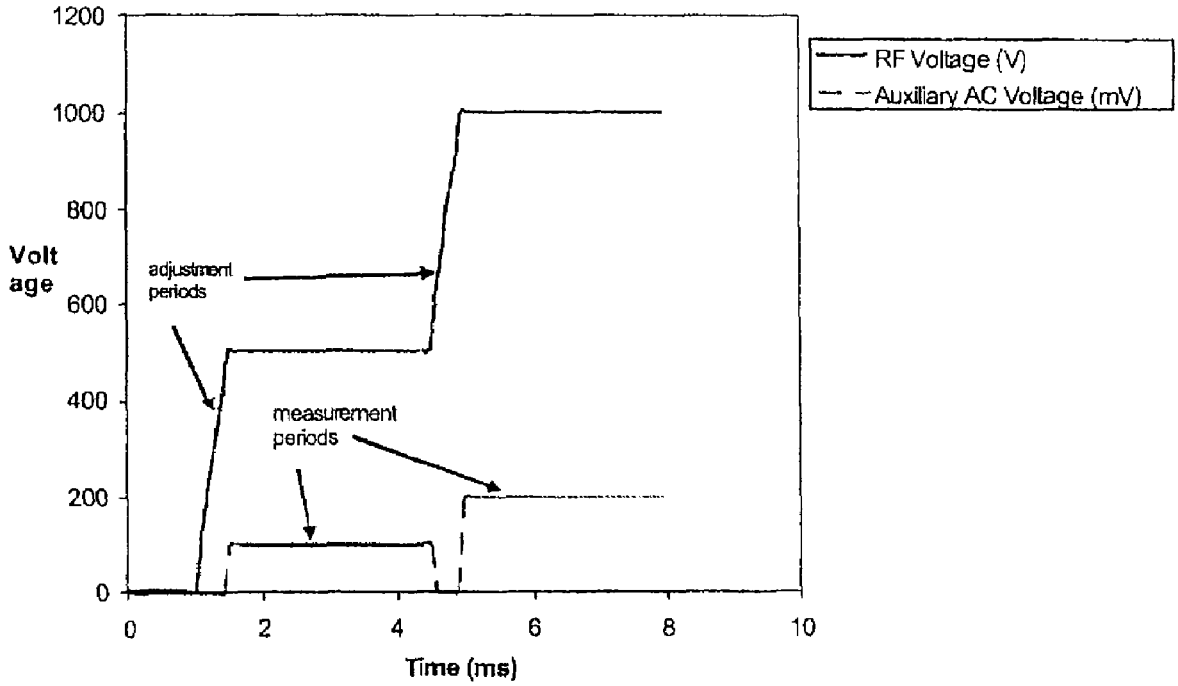
FIGS. 7 and 8, in graphs, illustrate adjustment and excitation time intervals with and without cooling periods between measurements.
Figure 8:
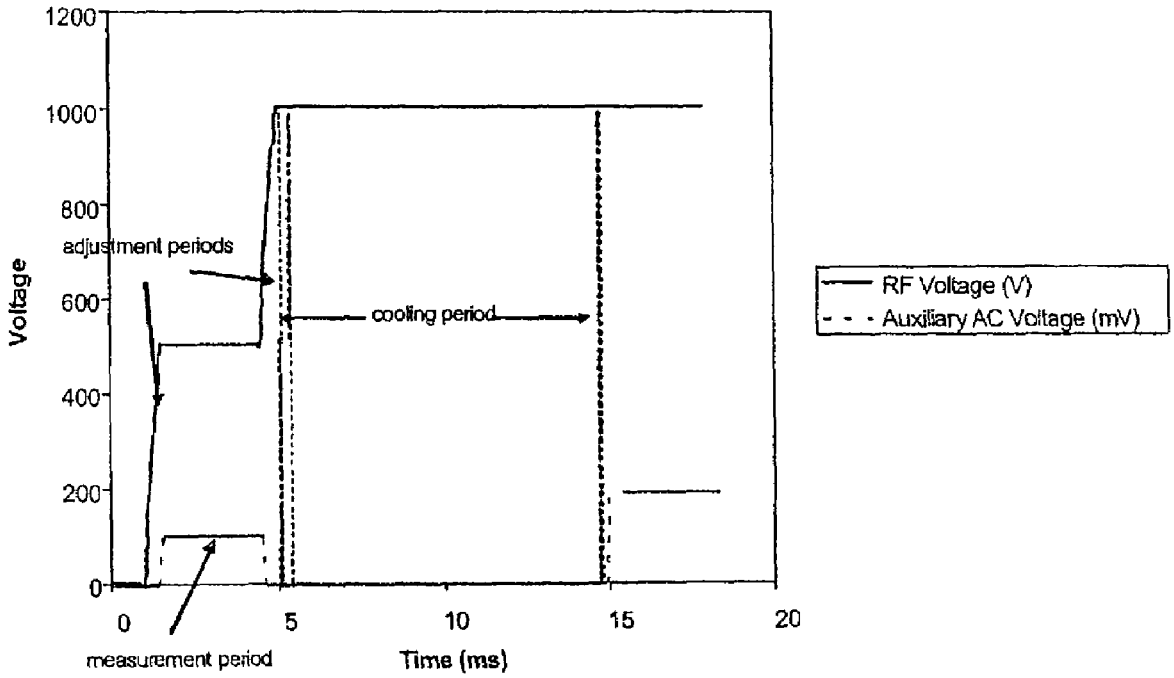

Referring to FIGS. 7 and 8, examples of the ejection process as initiated by jumps in the RF and auxiliary voltages are illustrated in graph. In both cases, the adjustment time interval or field adjustment time is 400 usec, and the measurement period is 3 ms. In the graph of FIG. 7, there is no cooling period between measurements, while in the graph of FIG. 8, a cooling period between measurements is provided. That is, in the graph of FIG. 8, the auxiliary AC voltage is turned off for approximately 10 ms between the measurement periods.

In the graphs of both FIGS. 7 and 8, the auxiliary AC voltage is shown as being turned off during the adjustment periods. However, as described above, this need not be the case, as the auxiliary AC voltage could be continuously provided during these excitement time intervals.

Time Lag

Figure 9:
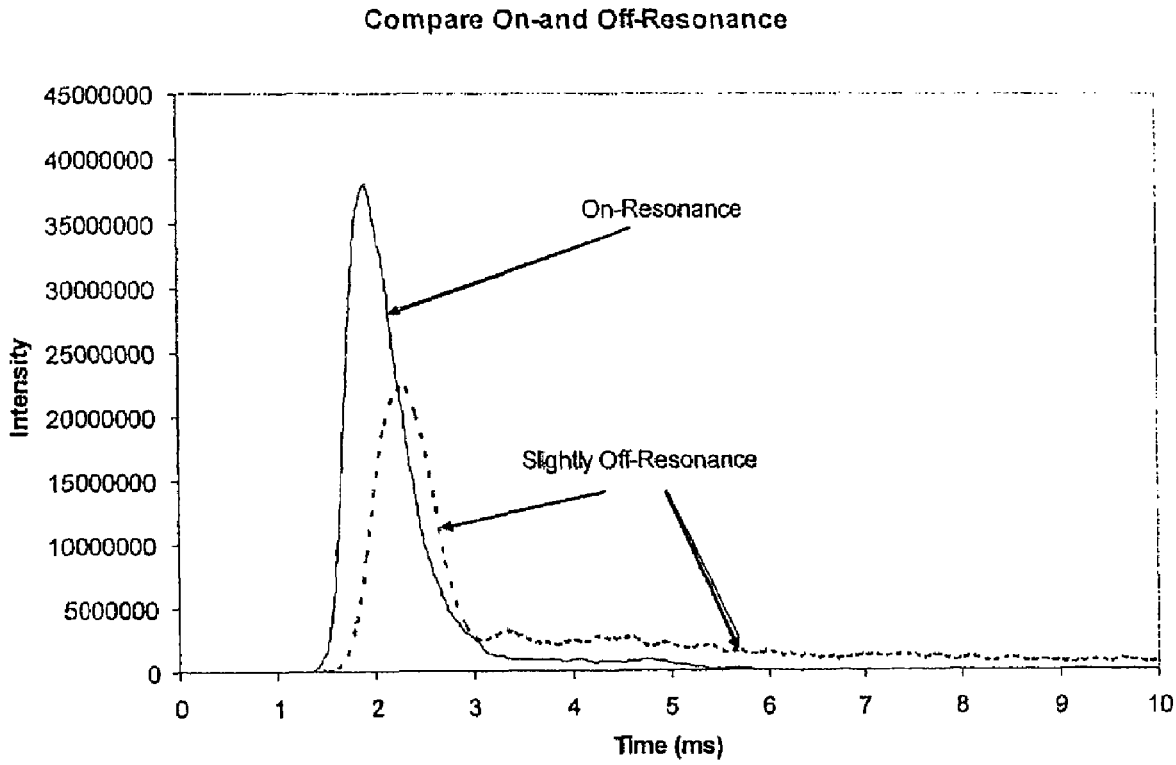
FIG. 9, in a graph, illustrates a time lag and the temporal profiles of both on-resonance and slightly off-resonance ions resulting from resonance excitation transfer.

In operation, after the adjustment time interval, there may be a period of 1-2 ms during which no ions emerge from the trap. The exact time to wait for the first ions to emerge from the trap is largely determined by the auxiliary AC amplitude. This is followed by a sharp peak in ion current that can be as narrow as 200 usec, but is more typically 600 usec when the detector is placed immediately after the linear ion trap. After that, there is a contribution to the ion current of ions that are slightly off resonance, but which become excited since they are being exposed to an excitation field for a greater period of time. The ejected on-resonance ions can thus be distinguished from the slightly off-resonance ions by simply adjusting the observation window to shorter time periods. As shown in FIG. 9, a sequence of time peaks (only two peaks in FIG. 9) can be generated over the excitement time interval by detecting the ejected ions. The first (and higher) time peak represents the on-resonance or selected ions, while the second time peak represents the off-resonance or unselected ions.

Referring to FIG. 9, the different temporal profiles of the on-resonance and slightly off-resonance ions are illustrated. As shown, the peak of the off-resonance occurs slightly after the peak of the on-resonance ions. Thus, by suitably selecting the observation window, much of the on-resonance temporal profile can be retained, while excluding most of the slightly off-resonance temporal profile.

Resonant Ejection

By analogy, the method can also be extended to linear ion traps with radial, rather than axial, ejection. Radial ejection linear ion traps have been previously disclosed in U.S. Pat. No. 5,420,425. The radial ejection linear ion trap can employ relatively high DC voltages on the end electrodes so that during ion ejection fringing field effects are minimized and ions can emerge through slots machined in the trapping electrodes or, when properly excited, between the trapping electrodes. Because of the significant axial trapping potentials, trapped ions are excited by a radially applied aggregate field and emerge through or between the trapping electrodes toward ion detectors, or alternatively, a collision cell and/or a time-of-flight mass spectrometer.

Figure 11:
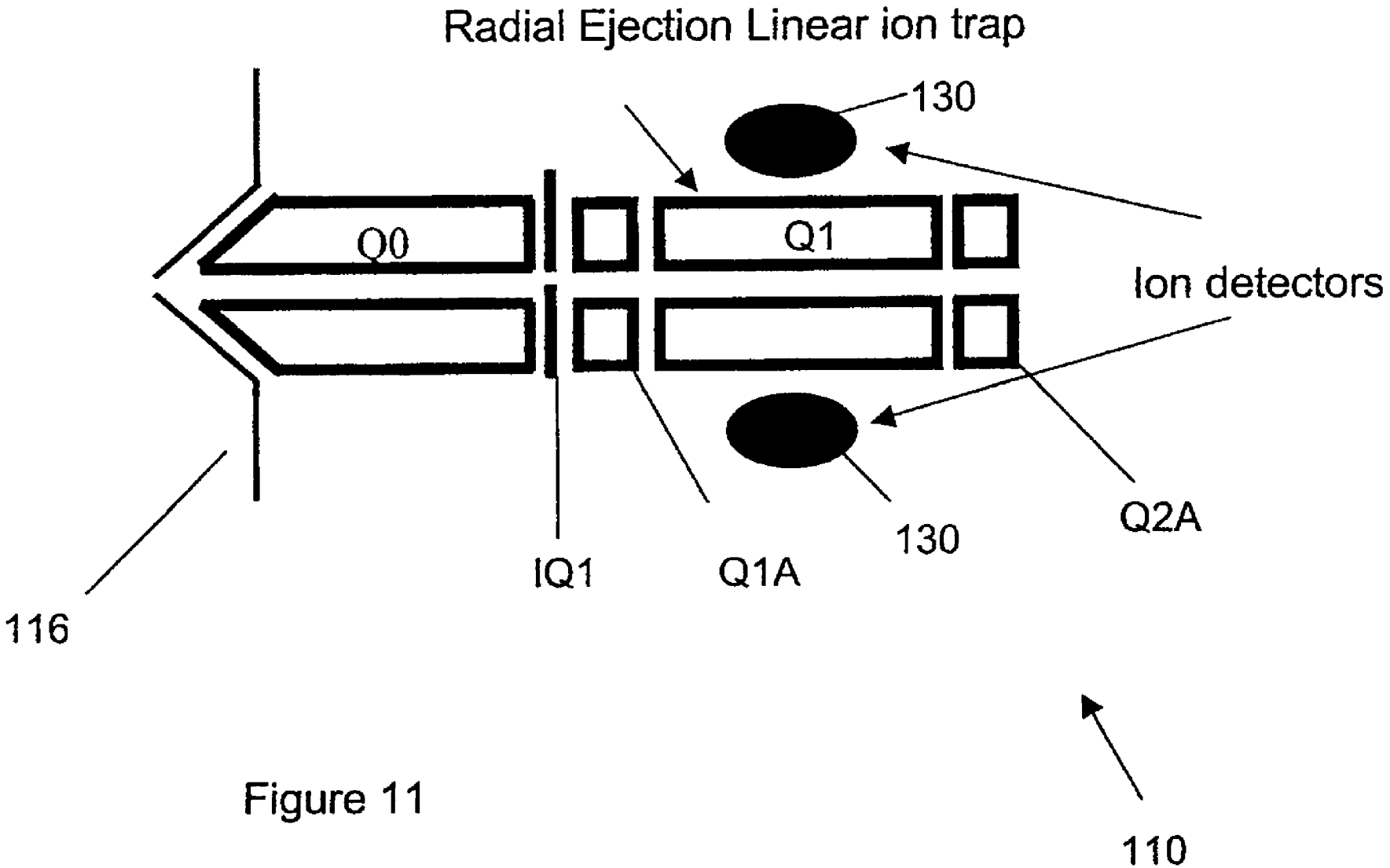
FIG. 11, in a schematic diagram, illustrates a yet further variant of a linear ion trap mass spectrometer system.

FIG. 11 shows a simple version of such a radial transfer linear ion trap. Here, the first group of trapped ions and the second group of trapped ions are ejected through the trapping electrodes to a pair of ion detectors by appropriately changing the characteristics of the aggregate field in a non-contiguous fashion as described above.

Referring to FIG. 11, there is illustrated in a schematic diagram a relatively simple variant of a radial transfer linear ion trap mass spectrometer system 110. The linear ion trap mass spectrometer system 110 comprises two elongated sets of rods Q0 and Q1 after rod set Q0. Additional sets of stubby rods Q1A and Q2A are provided at either end of elongated rod set Q1.

The linear ion trap mass spectrometer system 110 operates in a manner similar to that described above in connection with FIG. 1*a*, and for brevity this description is not repeated. For clarity, the same reference numerals, with 100 added, are used to designate components of the linear ion trap mass spectrometer system 110 of FIG. 11 that are analogous to corresponding elements of the linear ion trap mass spectrometer system 10 of FIG. 1*a*.

The linear ion trap mass spectrometer system 110 is configured for radial ejection. Accordingly, the ions trapped in Q1 can be resonantly excited, and then radially transferred through the trapping electrodes of Q1 to a pair of ion detectors 130 outside Q1. This can be done by appropriately changing the characteristics of the aggregate field in a non-contiguous manner, analogous to the process described above in connection with axial transfer.

Figure 12:
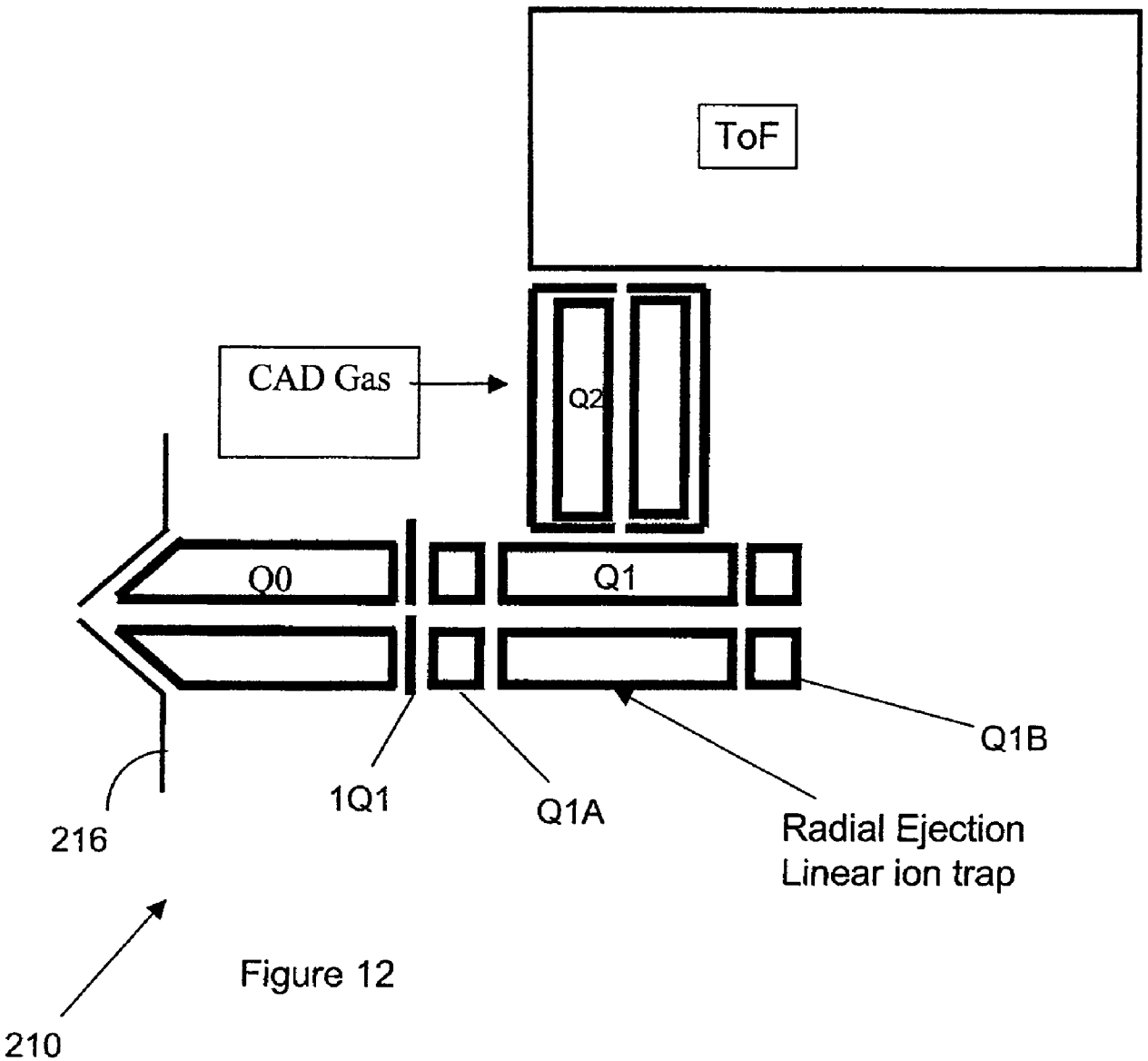
FIG. 12, in a schematic diagram, illustrates a still further variant of a linear ion trap mass spectrometer system.

FIG. 12 shows a schematic of apparatus that can be used to obtain high efficiency MS/MS of groups of ions by radially transferring a chosen group of ions through a collision cell and into a time-of-flight mass spectrometer. The group of ions that are transferred radially after changing the aggregate field in a non-contiguous manner can be accelerated into the collision cell pressurized with gas in which fragments are formed. The fragments and residual precursor ions can then be passed to a time-of-flight mass spectrometer for mass analysis.

More particularly, the linear ion trap mass spectrometer system 210 of FIG. 12 is similar to the mass spectrometer system 10 of FIG. 1*c*, except that Q1 is configured for radial as opposed to axial transfer. For brevity, the description of the linear ion trap mass spectrometer system 10 of FIG. 1*c* is not repeated with respect to the linear ion trap mass spectrometer system 210 of FIG. 12. For clarity, the same reference numerals, with 200 added, are used to designate components of the linear ion trap mass spectrometer system 210 of FIG. 12 that are analogous to components of the linear ion trap mass spectrometer system 10 of FIG. 1*c*.

In the mass spectrometer system 210 of FIG. 12, ions are emitted into Q1 via Q0 and stubby rods Q1A. Q1 is a linear ion trap. Within Q1, a first group of ions, having a selected mass to charge ratio, can then be selected for radial ejection. Next, a rapid shift or jump in the operating conditions of Q1 required to resonantly excite this first group of ions is provided. This rapid shift or jump can be made to either an amplitude or a frequency of the RF trapping field.

This resonant excitement of the first group of ions can be maintained for an excitement time interval, which may be at least one millisecond, resulting in resonant ejection of the first group of ions from Q1 to Q2. Within Q2, this first group of ions can then be fragmented, and subsequently axially ejected to the downstream Time of Flight (ToF) mass spectrometer for detection. Alternatively, Q2 can simply be used as a transmission mass spectrometer, such that the first group of ions from Q1 are simply transmitted without fragmentation to the Time of Flight mass spectrometer.

Other variations and modification of the invention are possible. For example, the descriptions of different aspects of embodiments of the present invention implemented on specific linear ion trap system configurations is by way of example only; aspects of the present invention may also be applied to other linear ion traps. All such modifications or variations are believed to be within the sphere and scope of the invention as defined by the claims appended hereto.

The invention claimed is:

1. A method of operating a mass spectrometer having a rod set, the rod set having a first end, a second end opposite to the first end, and a longitudinal axis extending between the first end and the second end, the method comprising:

a) admitting ions into the rod set;

b) trapping at least some of the ions in the rod set by i) producing a first barrier field at a first end member adjacent to the first end of the rod set, ii) producing a second barrier field at a second end member adjacent to the second end of the rod set, and iii) providing an aggregate field comprising an RF field between the rods of the rod set;

c) selecting a first selected mass to charge ratio of a first group of ions in the ions;

d) determining a first excitement level of a selected characteristic of the aggregate field for the first group of ions;

e) adjusting the selected characteristic of the aggregate field to the first excitement level to resonantly excite the first group of ions to mass selectively eject the first group of ions axially from the rod set past the barrier field; and, f) maintaining the selected characteristic of the aggregate field at the first excitement level during an excitement time interval wherein the excitation time interval is at least 1 millisecond.

2. The method as defined in claim 1 wherein the selected characteristic is one of an amplitude and a frequency of the RF field.

3. The method as defined in claim 1 wherein the aggregate field comprises an excitation AC field, the selected characteristic being a frequency of the excitation AC field, and the excitation AC field being one of a dipole excitation voltage and a quadrupole excitation voltage.

4. The method as defined in claim 1 wherein the mass spectrometer further comprises a set of auxiliary electrodes, the excitation AC field being provided by the set of auxiliary electrodes.

5. The method as defined in claim 1 further comprising selecting a second group of ions of a second selected mass to charge ratio from the ions;

determining a second excitement level of the selected characteristic of the aggregate field for the second group of ions; and, after step f), adjusting the selected characteristic of the aggregate field to the second excitement level to resonantly excite the second group of ions to mass selectively eject the second group of ions axially from the rod set past the barrier field, and then maintaining the selected characteristic of the aggregate field at the second excitement level during a second excitement time interval wherein the second excitation interval is at least 1 millisecond.

6. The method as defined in claim 5 wherein the step of adjusting the selected characteristic of the aggregate field to the second excitement level comprises adjusting the selected characteristic of the aggregate field from the first excitement level to the second excitement level in less than 1 millisecond.

7. The method as defined in claim 5 wherein the first group of ions differs by more than 1 amu from the second group of ions.

8. The method as defined in claim 7 wherein the selected characteristic is substantially constant over the excitation time interval and the second excitation time interval.

9. The method as defined in claim 1 wherein step b) comprises i) providing a first DC voltage difference between the first end member and the rod set to provide the first barrier field, and ii) providing a second DC voltage difference between the second end member and the rod set to provide the second barrier field.

10. The method as defined in claim 9 wherein the first DC voltage difference and the second DC voltage difference are equal.

11. The method as defined in claim 1 wherein step b) comprises i) providing a first AC voltage difference between the first end member and the rod set to provide the first barrier field, and ii) providing a second AC voltage difference between the second end member and the rod set to provide the second barrier field.

12. The method as defined in claim 11 wherein the first AC voltage difference and the second AC voltage difference are equal.

13. The method as defined in claim 1 wherein step e) further comprises axially ejecting the first group of ions to a detector; and, the method further comprises detecting at least some of the axially ejected first group of ions.

14. The method as defined in claim 1 wherein step e) further comprises axially ejecting the first group of ions to a downstream ion trap; and, the method further comprises g) further processing the first group of ions in the downstream ion trap.

15. The method as defined in claim 1 wherein step e) further comprises axially ejecting the first group of ions to a downstream collision cell; and, the method further comprises fragmenting the first group of ions in the collision cell and then axially ejecting the first group of ions to a downstream mass spectrometer for mass analysis.

16. The method as defined in claim 15 wherein the downstream mass spectrometer is a linear ion trap mass spectrometer, and the method further comprises storing the first group of ions in the linear ion trap mass spectrometer.

17. The method as defined in claim 15 wherein the downstream mass spectrometer is a time of flight mass spectrometer.

18. The method as defined in claim 5, wherein at least one of the first excitation interval and the second excitation interval is at least 5 milliseconds.

19. The method as defined in claim 16, wherein at least one of the first excitation interval and the second excitation interval is at least 20 milliseconds.

20. The method as defined in claim 1 further comprising storing a sample of ions upstream of the rod set; and, step a) comprises admitting a first batch of ions from the sample ions into the rod set.

21. The method as defined in claim 20 wherein the sample ions are stored in a high pressure mass spectrometer operating at more than twice an operating pressure of the rod set, and the method further comprises switching a barrier-generating member between the high pressure mass spectrometer and the rod set to an attractive mode during step a) to facilitate transfer of the first batch of ions from the high pressure mass spectrometer to the rod set, and to a repulsive mode during steps b) to f) to facilitate retaining the sample ions other than the first batch of ions in the high pressure mass spectrometer.

22. The method as defined in claim 21 wherein the high pressure mass spectrometer operates at more than ten times the operating pressure of the rod set.

23. The method as defined in claim 20 wherein the sample ions are stored in a MALDI source, and step a) comprises pulsing the MALDI source for a required number of times to fill the rod set.

24. The method as defined in claim 20 wherein the sample ions are stored in a nanospray source, and step a) comprises turning on the nanospray source to admit the first batch of ions into the rod set, and then turning off the nanospray source.

25. The method as defined in claim 20 wherein the sample ions are stored in an ion source upstream of the rod set, and step a) comprises turning on the ion source to admit the first batch of ions into the rod set, and then turning off the ion source.

26. The method as defined in claim 20 further comprising, after steps a) to f), admitting a second batch of ions from the sample ions stored in the high pressure mass spectrometer into the rod set.

27. The method as defined in claim 1 further comprising detecting ions including the first group of ions ejected from the rod set;

generating a sequence of time peaks over the excitement time interval; and selecting the first time peak in the sequence of time peaks as corresponding to the first group of ions.

28. The method as defined in claim 27 further comprising selecting a subsequent time peak in the sequence of time peaks as corresponding to an off-resonance group of ions different from the first group of ions.

29. A method of operating a mass spectrometer having a rod set, the rod set having a first end, a second end opposite to the first end, and a longitudinal axis extending between the first end and the second end, the method comprising:

a) admitting ions into the rod set;

b) trapping at least some of the ions in the rod set by i) producing a first barrier field at a first end member adjacent to the first end of the rod set, ii) producing a second barrier field at a second end member adjacent to the second end of the rod set, and iii) providing an aggregate field comprising an RF field between the rods of the rod set;

c) selecting a first selected mass to charge ratio of a first group of ions in the ions;

d) determining a first excitement level of a selected characteristic of the aggregate field for the first group of ions;

e) adjusting the selected characteristic of the aggregate field to the first excitement level to resonantly excite the first group of ions to mass selectively eject the first group of ions radially from the rod set past the barrier field; and, f) maintaining the selected characteristic of the aggregate field at the first excitement level during an excitement time interval wherein the excitation time interval is at least 1 millisecond.

30. The method as defined in claim 29 wherein step e) further comprises radially ejecting the first group of ions to a downstream collision cell; and, the method further comprises fragmenting the first group of ions in the collision cell and then ejecting the first group of ions to a downstream mass spectrometer for mass analysis.

31. The method as defined in claim 30 wherein the downstream mass spectrometer is a time of flight mass spectrometer.

* * * * *